United States Patent [19]

Rayner

[11] 4,213,597

[45] Jul. 22, 1980

[54] CLOTHES LINE SEPARATOR

[76] Inventor: Ross H. Rayner, Box 687, Sicamous, British Columbia, Canada, V0E 2V0

[21] Appl. No.: 916,875

[22] Filed: Jun. 19, 1978

[51] Int. Cl.[2] ..... B66D 1/36

[52] U.S. Cl. ..... 254/388; 211/119.02; 24/132 R; 254/391

[58] Field of Search ..... 254/190 A, 175.3, 135 R, 254/190 R, 193, 194, 195, 198, 134.3 R; 211/119.02, 119.03, 119.01, 119.04, 119.05, 119.09, 119.13, 121, 122; 24/84 R, 115 M, 115 R, 132 R, 230.5 AD, 120, 122.6, 128 K, 133, 132 WL, 134 R, 134 KA, 134 P, 134L, 81 C, 81 AY, 81 AD, 171.1; 248/63, 49, 58, 62; 174/146, 147; 256/35, 47, 54–57

[56] References Cited

U.S. PATENT DOCUMENTS

| | | | |
|---|---|---|---|
| 692,864 | 2/1902 | Lantz | 254/190 A |
| 2,363,564 | 11/1944 | Waldheim | 211/119.02 |
| 3,010,700 | 11/1961 | Petersen | 254/193 |
| 3,199,841 | 8/1965 | McKean | 254/193 |

FOREIGN PATENT DOCUMENTS

| | | | |
|---|---|---|---|
| 825601 | 12/1959 | United Kingdom | 211/119.02 |

*Primary Examiner*—Kenneth W. Noland

*Attorney, Agent, or Firm*—Fulwider, Patton, Rieber, Lee & Utecht

[57] ABSTRACT

An elongate frame having a pulley at one end adapted to ride on the upper run of a clothes line, and a clamp mounted on the frame at the opposite end thereof operable to grip the lower run of the clothes line. The clamp is in the form of a bar swingably mounted on the frame and having a lower clamping end and an upper gate end which normally prevents the separator from coming off the line upper run.

11 Claims, 7 Drawing Figures

CLOTHES LINE SEPARATOR

FIELD OF THE INVENTION

This invention relates to a separator for endless clothes lines extending around spaced pulleys and having generally parallel upper and lower runs.

DESCRIPTION OF THE PRIOR ART

Endless clothes lines travel around pulleys which are mounted on suitable supports, these supports being spaced from each other at opposite ends of the area in which clothes are to be hung. As the line has to be pulled around the pulleys, it cannot be drawn too tightly when it is originally installed. As a result, a line of this type has a catenary curve between the pulleys. Clothes or the like are hung on a lower run of the line and as the weight increases on the lower run it sags further while the upper run is drawn taut. As a result the pullleys have to be located quite high relative to the ground in order to keep the clothes clear of the latter. This makes it relatively difficult to hang the clothes on the line.

There is a retainer on the market for holding the upper and lower runs of a clothes line substantially parallel when clothes are hung on the lower run thereof. The prior art retainer has a pulley in an open upper channel adapted to ride on the upper run of the line, and another pulley in an open lower channel and positioned to support the line lower run. These channels open towards each other. As the drying clothes are whipped by the wind, one or both of the pulleys frequently come off the line with the result that the lower run drops downwardly relative to the upper run. In other words, the dryer retainer cannot be relied upon to hold up the loaded lower run. Another difficulty is that the prior holder is free to run along the line. Consequently, if a single article, such as a blanket, is hung on the line, the holder has to be located thereon ahead of the blanket so that the latter moves the holder outwardly as the lower run is moved in that direction. However, when the lower run is drawn inwardly so that the blanket can be removed, the retainer does not come with it.

SUMMARY OF THE INVENTION

The retainer in accordance with this invention eliminates these problems. It has a pulley adapted to ride on the upper run of the clothes line, and a clamp below this pulley which is operable to grip the lower run of the line. This holder also includes a gate which is positioned normally to prevent the pulley from jumping off the upper run of the line.

With this arrangement, the holder cannot jump off the line runs regardless of any whipping action on the clothes in the wind, and the holder always moves with the lower run so that it cannot remain out of reach of the person hanging the clothes on or removing them from the line.

A clothes line retainer in accordance with this invention comprises an elongate frame, an upper channel on an upper end of the frame, a pulley in the channel and positioned to ride on the upper run of a clothes line extending across the frame and through the channel, said channel having an entrance facing downwardly relative to the frame, and a clamp mounted on the frame adjacent a lower end thereof, said clamp being operable to grip the lower run of said clothes line extending across the frame, whereby longitudinal movement of the clothes line lower run gripped by said clamp shifts the pulley riding on the line upper run and consequently the frame along said upper run.

In a preferred aspect, the retainer comprises an elongate frame, an upper channel on an upper end of the frame, a pulley in the channel and positioned to ride on the upper run of a clothes line extending across the frame and through the channel, said channel having an entrance facing downwardly relative to the frame, a lower channel on a lower end of the frame and having an entrance facing upwardly relative to the frame, a bar extending generally parallel to the frame between the upper and lower channels thereof, pivot means above the lower channel mounting the bar on the frame for swinging movement laterally of the frame, said bar having a clamping end on one side of the pivot means fitting in the lower channel to clamp the line lower run therein, and said bar having a gate end on the opposite side of the pivot means extending towards and terminating near the upper channel to close the entrance thereof, whereby when the bar is swung laterally relative to the frame, the clamping end thereof releases the line lower run and the gate end thereof clears said entrance.

Three examples of this invention are illustrated in the accompanying drawings in which, FIG. 1 diagrammatically illustrates an endless clothes line with a retainer thereon, FIG. 2 is an end elevation of a preferred form of retainer according to this invention, this retainer being shown in operative position on a clothes line, FIG. 3 is a front elevation of the retainer on the line, FIG. 4 is a front elevation showing the clamp of the retainer in the release position;

FIG. 5 is a view similar to FIG. 2 of an alternative form of retainer according to this invention, FIG. 6 illustrates a further embodiment of the invention; and FIG. 7 illustrates a variation of the embodiment of FIG. 6.

DESCRIPTION OF THE PREFERRED EMBODIMENTS

Figure 1:
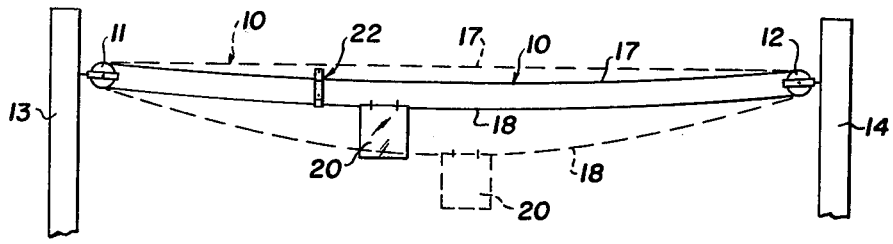

Referring to FIG. 1 of the drawings, 10 is an endless clothes lines extending around spaced pulleys 11 and 12 mounted on suitable supports 13 and 14 at opposite ends of the area of which clothes and the like are to be hung. The line 10 has an upper run 17 and a lower run 18, and this Figure shows an article 20 hung on the lower run of the line, and a retainer 22 according to this invention riding on the upper run 17 and gripping and supporting the lower run 18. This Figure also illustrates the line 10 in dotted lines to show what would happen if the retainer 22 were not present. The upper run 17 is taut, while the lower run 18 sags so that the article 20 hangs closer to the ground.

Figure 2:
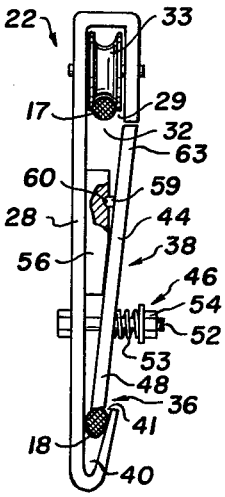
Figure 3:
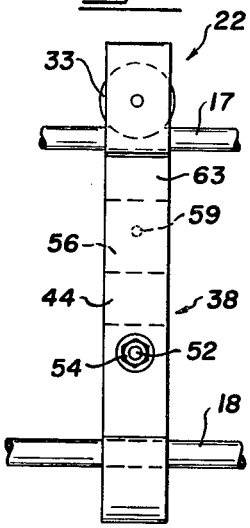
Figure 4:
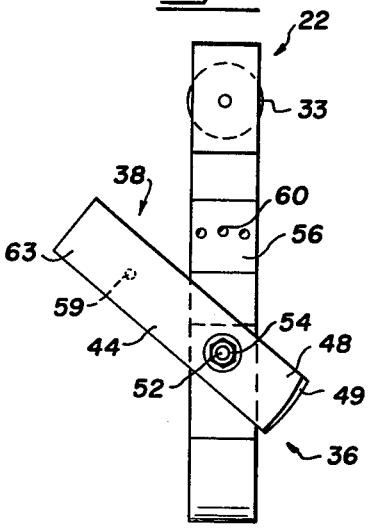

FIGS. 2 to 4 illustrate the preferred hanger 22. This hanger is made up of an elongate frame 28 having an upper channel 29 formed at an upper end thereof. In this example, the frame 28 is formed of a strip of suitable material, such as metal, which is bent at its upper end into an inverted U to form channel 29 which has an entrance 32 opening downwardly relative to the frame. The terms "upper" and "lower" are used with the various elements of this retainer when said retainer is in operating position. A pulley 33 is rotatably mounted in channel 29 and positioned to ride on the upper run 17 of the clothes line 10 which extends across frame 28.

A clamp 36 is located on frame 28 at the lower end thereof. This clamp is operable to grip the lower run 18 of the clothes line which also extends across frame 28. A gate 38 is swingable mounted on the frame and normally closes the channel entrance 32.

The clamp 36 comprises a lower channel 40. This lower channel is substantially V-shaped in cross section as clearly shown in FIG. 2, and has an entrance 41 facing upwardly relative to frame 28. A bar 44 extends generally parallel to frame 28 and is connected thereto by pivot means 46.

Bar 44 has a clamping end 48 extending into lower channel 40. This clamping end has a wedge 49 formed on its outer or lower end. Bar 44 is swingably mounted on a bolt 52 which extends through frame 28 and the bar. A coil spring 53 is mounted on the bolt and is pressed against bar 44 by a nut 54 threaded on said bolt. This spring resiliently urges the bar against a tapered block 56 which is fixedly mounted on and forms part of frame 28.

The holder 22 includes a latch for releasably retaining bar 44 and its clamping end 48 in the clamping position. In this example the latch consists of a pin 59 on and projecting inwardly from bar 44, this pin being adapted to fit into any one of a plurality of holes 60 formed in frame block 56, said holes 60 being arranged in a curve, the center of curvature of which is the axis of bolt 52, see FIG. 4.

Gate 38 is formed by the opposite or upper end 63 of bar 44. This bar end 63 extends towards and terminates near the upper channel 29 and normally closes the entrance 32 of this channel, see FIG. 2.

It is a simple matter to install separator 22 on line 10. Bar 44 is swung laterally relative to frame 28, see FIG. 4, to clear the clamping end 48 of the bar of lower channel 40. At the same time, the gate end 63 of the bar opens the entrance 32 of upper channel 29. Spring 53 permits bar 44 to be drawn outwardly from block 56 so as to clear pin 59 of the hole 60 in which it was located and thereby permit the bar to be swung laterally at this time.

The separator 22 is now moved to permit the upper run 17 of the clothes line to enter channel 29 so that pulley 33 can ride on this run. The lower run 18 of the line is inserted in the lower channel 40. When bar 44 is swung back to its normal position, the wedge 49 of the clamping end 48 of the bar moves down in the V-shaped channel 40 so that retainer 22 is firmly secured to this lower run. When the bar is moved to its normal position, its pin 59 is inserted into one of the holes 60 of frame block 56 so that the bar cannot be accidentally swung out of its normal position. At this time, the gate end 63 of bar 44 closes the entrance 32 of upper channel 29 so that pulley 33 cannot jump off the upper run 17 of the line. When the lower run 18 is moved longitudinally in either direction, clamp 36 which is gripping the lower run, causes the retainer to move with the lower run, while pulley 33 rides on the upper run. Thus, the person who is moving the lower run of the clothes line always has control of retainer 22. In addition to this, the lower run is firmly gripped by the retainer, and the upper channel is closed by the retainer gate so that the retainer cannot jump off either of the runs of the line.

Figure 5:
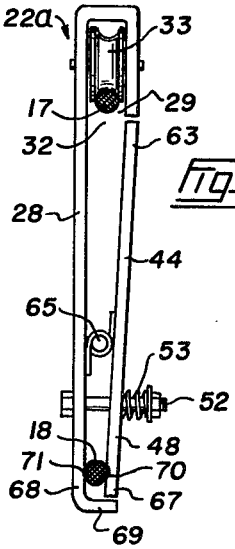

FIG. 5 illustrates an alternative form of retainer **22*a*. In this example, the lower channel 40 has been eliminated, and bar 44 is mounted on frame 28 by suitable pivot means, such as hinge 65. This hinge extends laterally of the bar and the frame, and is located above bolt 52. The clamping end 48 of bar 44 forms a jaw 67 opposed to another jaw 68 formed by the lower end of frame 28. Spring 53 on bolt 52 urges jaw 67 towards jaw 68 to clamp the lower run 18 of the clothes line therebetween. The jaws 67 and 68 are preferably formed with opposed grooves 70 and 71 to accommodate the lower run therein. It is also desirable to provide lug 69 at the lower end of jaw 68 to retain the lower run 18**.

Retainer **22*a* functions in the same manner as retainer 22. In the former, the gate end 63 of bar 44 closes the entrance 32 of upper channel 29 to retain pulley 33 on the upper run 17 of the clothes line. At the same time, the jaws 67, and 68 grip the lower run of the line so that the retainer moves with the latter. When the gate end 63 of bar 44 is pressed against frame 28, the upper channel is opened while jaw 67 moves away from jaw 68 to release lower run 18**.

Figure 6:
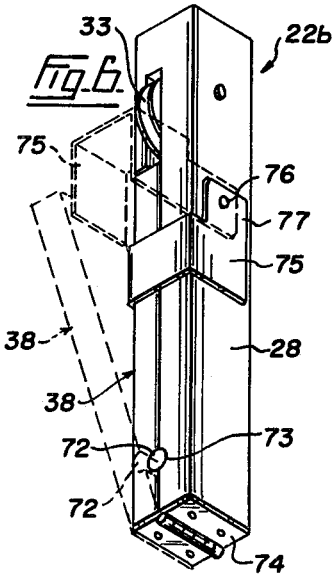
Figure 7:
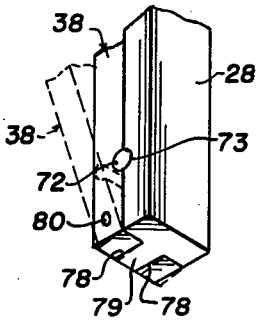

FIG. 6 illustrates a retainer **22*b* having the elongate frame 28 and pulley 33 illustrated in the previous drawings. In the embodiment of FIG. 6 the gate 38 is formed with a recess 72. There is a corresponding recess 73 in the elongate frame 28 and the recesses 72 and 73 cooperate, when the retainer is on a line and the frame 28 and gate 38 are held together, to form an opening, as shown in FIGS. 6 and 7. The recesses are dimensioned to form a tight grip on the lower run 18 of the clothes line 10. There is a pivotal joint, shown in FIG. 6 as a hinge 74. As is conventional the hinge 74 is made up of two leaves and one leaf is attached to the frame 28 and the other to the gate 38. Thus the retainer of FIG. 6 can assume the position shown in broken lines in FIG. 6, that is the gate 38 can hinge or pivot away from the frame 28**.

There are means to hold the gate 38 and elongate frame 28 together. In FIG. 6 this means comprises a clip 75 pivotally mounted at 76 and provided with a limb 77 so that the clip 75 can pivot from the clamping or locking position shown in FIG. 6 in solid lines to the position shown in broken lines in FIG. 6, where it does not retain the gate 38.

In the modification shown in FIG. 7 there is a recess 78 formed adjacent the lower end of the gate 38. A lug 79 is positioned at the lower end of the elongate frame 28 and engages in the recess 78. A pivot pin 80 extends through the frame and the gate to provide the necessary pivotal joint.

It will be appreciated that retainer **22*b* functions in the same way as the previous embodiment. Closing of the entrance 32 of upper channel 29 is carried out when the gate 38 is in the solid line position shown in FIGS. 6 and 7. Recesses 72 and 73** grip the lower run of the line to provide the necessary clamping.

I claim:

1. A retainer for endless clothes lines extending around spaced pulleys and having generally parallel upper and lower runs, said retainer comprising an elongate frame, an upper channel on an upper end of the frame, a pulley in the channel, and positioned to ride on the upper run of a clothes line extending across the frame and through the channel, said channel having an entrance facing downwardly relative to the frame, and a releasable clamp adjacent a lower end of the frame, said clamp being movable from a first position, where it can grip the lower run of said clothes line extending across the frame, to a second position, where the lower line is released, whereby longitudinal movement of the clothes line lower run, when it is gripped by said clamp, shifts the pulley riding on the line upper run and consequently the frame along said upper run, and said clamp comprises a gate extending from an end of said downwardly facing entrance of said upper channel and substantially along the length of said elongate frame so that when said clamp is in said first position said clamp retains said upper run in said upper channel, and when said clamp is in said second position said clamp permits the release of said upper run from said upper channel.

2. A retainer as claimed in claim 1 said gate swingably mouunted on said frame normally closing the channel entrance and movable to open said entrance.

3. A retainer as claimed in claim 1 in which said clamp comprises a lower channel on the lower end of the frame and having an entrance facing upwardly relative to the frame, a bar extending generally parallel to the frame and pivot means above the lower end of the frame swingably mounting the bar on the frame, said bar having a clamping end extending into the lower channel to clamp the line lower run therein, said clamping end releasing the lower run when said bar is swung relative to the frame.

4. A retainer as claimed in claim 3 comprising means for releasably securing said bar to the frame when the clamping end thereof is clamping the lower run in the lower channel.

5. A retainer as claimed in claim 2 in which the gate is formed with a recess;

a corresponding recess in said elongate frame to form, with the recess in said gate, said clamp when the gate and elongate frame are held together;

a pivotal joint adjacent the lower end of said frame; and means to hold the gate and elongate frame together to grip the lower run of a clothes line in said recess.

6. A retainer as claimed in claim 5 in which the ivotal joint comprises a hinge having two leaves, one leaf mounted on the end of said elongate frame and the other leaf mounted on the end of said gate.

7. A retainer as claimed in claim 5 in which there is another recess formed in said gate;

a lug to engage said another recess, said lug extending from an end of said elongated frame; and a pivot pin extending through said frame and said gate.

8. A retainer as claimed in claim 1 in which said clamp also comprises a bar extending generally parallel to the frame, pivot means above the lower end of the frame swingably mounting the bar on the frame, said bar having a clamping end, a clamping end and said lower frame end forming opposed gripping jaws, and a spring urging said clamping end towards the frame lower end to grip the lower run of said clothes line therebetween.

9. A retainer as claimed in claim 8 in which said pivot means comprises a hinge connecting the bar to the frame, said hinge extending laterally of the longitudinal length of said bar and frame.

10. A retainer for endless clothes lines extending around spaced pulleys and having generally parallel upper and lower runs, said retainer comprising an elongate frame, an upper channel on an upper end of the frame, a pulley in the channel and positioned to ride on the upper run of a clothes line extending across the frame and through the channel, said channel having an entrance facing downwardly relative to the frame, a lower channel on a lower end of the frame and having an entrance facing upwardly relative to the frame, a bar extending generally parallel to the frame between the upper and lower channels thereof, pivot means above the lower channel mounting the bar on the frame for swinging movement laterally of the frame, said bar having a clamping end fitting in the loweer channel to clamp the line lower run therein, and said bar having a gate end on the opposite end extending towards and terminating near the upper channel to close the entrance thereof, whereby when the bar is swung laterally relative to the frame, the clamping end thereof releases the line lower run and the gate end thereof clears said entrance.

11. A retainer as claimed in claim 10 in which said pivot means comprises a bolt extending through the frame and the bar, and comprising a spring on the bolt pressing the bar towards the frame, a latch pin on the bar extending towards the frame, and an opening in the frame to receive the latch pin when the bar is extending substantially parallel to the frame releasably to latch the bar against movement.

* * * * *